US010533769B2

(12) United States Patent
Volkmann et al.

(10) Patent No.: US 10,533,769 B2
(45) Date of Patent: Jan. 14, 2020

(54) HEATING DEVICE

(71) Applicant: Viessmann Werke GmbH & Co KG, Allendorf (DE)

(72) Inventors: Norbert Volkmann, Berlin (DE); Ulas Sahin, Berlin (DE); Dennis Lange, Berlin (DE); Alexander Guhl, Berlin (DE)

(73) Assignee: Viessmann Werke GmbH & Co KG, Allendorf (DE)

( * ) Notice: Subject to any disclaimer, the term of this patent is extended or adjusted under 35 U.S.C. 154(b) by 0 days.

(21) Appl. No.: 15/662,544

(22) Filed: Jul. 28, 2017

(65) Prior Publication Data

US 2019/0032955 A1 Jan. 31, 2019

(51) Int. Cl.

| | |
|---|---|
| ***F24H 1/28*** | (2006.01) |
| ***F28F 1/40*** | (2006.01) |
| ***F28D 21/00*** | (2006.01) |
| *F24H 9/00* | (2006.01) |

(52) U.S. Cl.

CPC ..... *F24H 1/287* (2013.01); *F28D 21/0005* (2013.01); *F28F 1/40* (2013.01); *F24H 9/0026* (2013.01); *F28D 2021/0024* (2013.01); *F28F 2215/04* (2013.01); *F28F 2215/10* (2013.01)

(58) Field of Classification Search

CPC ..... F28F 2215/10; F28F 2215/04; F28F 1/40; F24H 9/0026; F24H 1/287

See application file for complete search history.

(56) References Cited

U.S. PATENT DOCUMENTS

| | | | | |
|---|---|---|---|---|
| 1,524,520 | A * | 1/1925 | Junkers | F28F 1/24 126/118 |
| 2007/0137841 | A1* | 6/2007 | Bjork | F28F 1/126 165/153 |
| 2011/0017433 | A1* | 1/2011 | Feberwee | F24H 1/38 165/157 |
| 2012/0291998 | A1* | 11/2012 | Anderson | F28F 9/0243 165/104.14 |
| 2015/0198372 | A1* | 7/2015 | Desikan | F28D 1/0366 165/151 |

FOREIGN PATENT DOCUMENTS

| | | |
|---|---|---|
| CH | 111 633 A | 8/1925 |
| DE | 83 23 656 U1 | 12/1983 |
| DE | 86 01 896 U1 | 4/1986 |
| DE | 44 12 714 A1 | 10/1995 |
| DE | 44 21 671 A1 | 1/1996 |
| DE | 10 2007 060 508 A1 | 6/2009 |

(Continued)

*Primary Examiner* — Steven S Anderson, II
(74) *Attorney, Agent, or Firm* — Collard & Roe, P.C.

(57) ABSTRACT

A heating device has a combustion chamber and a gas flue configured to guide hot exhaust gas generated in the combustion chamber, the flue having an inlet region and an outlet region and is configured connected to the combustion chamber via the inlet region. Heat transfer ribs having a wall thickness are arranged spaced from each other in the gas flue for the heat transfer from hot exhaust gas to the gas flue. The wall thickness of the heat transfer ribs and/or the distances of the heat transfer ribs to one another are optionally configured to be larger on the sides of the inlet region than on the sides of the outlet region.

9 Claims, 2 Drawing Sheets

(56) References Cited

FOREIGN PATENT DOCUMENTS

| | | | | | |
|---|---|---|---|---|---|
| DE | 102014011147 | A1 | * | 1/2016 | ..... F28F 1/40 |
| EP | 271434 | | * | 6/1988 | |
| EP | 0 632 239 | A1 | | 1/1995 | |
| EP | 0 730 127 | A1 | | 9/1996 | |
| EP | 2 863 160 | A1 | | 4/2015 | |
| JP | H0375233 | A | * | 3/1991 | ..... C03B 37/0206 |
| JP | 2015132421 | A | * | 7/2015 | ..... F28F 21/084 |
| WO | WO 2011119073 | A2 | * | 9/2011 | ..... F24H 1/08 |

* cited by examiner

HEATING DEVICE

BACKGROUND OF THE INVENTION

1. Field of the Invention

The invention relates to a heating device according to the preamble of claim 1.

2. Description of the Related Art

A heating device of the type mentioned at the outset is known from the patent document EP 0 632 239 A1. This heating device consists of a combustion chamber and a gas flue configured for guiding hot exhaust gas generated in the combustion chamber, wherein this has an inlet region and an outlet region and is configured connected to the combustion chamber via the inlet region and wherein heat transfer ribs having a wall thickness are arranged in the gas flue for transfer of heat from the hot exhaust gas to the gas flue. These heat exchange ribs, which can be formed, for example, as an aluminum extrusion press profile or also from a folded sheet, thereby extend in the cross-section unchanged from the inlet region to the outlet region. The gas flue itself is surrounded externally in a known manner by the heater circuit water flowing through from the heating device.

SUMMARY OF THE INVENTION

The invention is based on the object of improving a heating device of the type mentioned at the outset. In particular, a heating device with a further improved heat transfer in the region of the gas flue from the exhaust gas to the heater circuit water is to be provided.

This object is achieved with a heating device comprising a combustion chamber and a gas flue configured to guide hot exhaust gas generated in the combustion chamber, wherein the gas flue has an inlet region and an outlet region and is configured connected to the combustion chamber via the inlet region. Heat transfer ribs having a wall thickness are arranged spaced from each other in the gas flue for the heat transfer from hot exhaust gas to the gas flue.

According to the invention, it is thus provided that, on the side of the inlet region, the wall thickness of the heat transfer ribs and/or the distances of the heat transfer ribs to one another are optionally configured greater than on the side of the outlet region.

In other words, the solution according to the invention is distinguished by the fact that structural measures are taken on the gas flue which take account of an exhaust gas flow cooling between the inlet region and outlet region. On the side of the inlet region, i.e., where the temperature of the exhaust gas is still comparatively high, a thicker-walled heat transfer rib is optionally used as at the outlet region and/or a larger distance between the heat transfer rib than at the outlet area is selected with regard to the larger gas volume at higher temperatures at the inlet area. These measures lead, in particular in combination with one another, which will be explained in more detail below, to a gas flue optimally adapted to the respective temperature of the exhaust gas cooling in the gas flue course.

The alternative solution, which lies in the hand with respect to the variation of the wall thickness, namely to simply provide a temperature-resistant material on the side of the inlet region as on the outlet region, is thereby not intended to solve the problem in so far as the processing of different materials in the course of the gas flue would be complicated and predictably problematic due to different thermal expansion of the different materials.

BRIEF DESCRIPTION OF THE DRAWINGS

The heating device according to the invention, including its advantageous further developments according to the dependent patent claims, is explained in more detail in the following with the aid of the illustrative representation of various exemplary embodiments.

In the drawings.

DETAILED DESCRIPTION OF PREFERRED EMBODIMENTS

Figure 1:
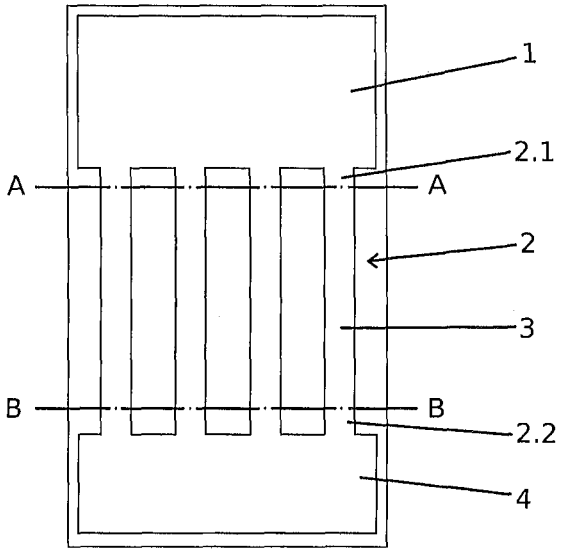
FIG. 1 schematically the heating device according to the invention with a combustion chamber, having four gas flues surrounded by heater circuit water, and having an exhaust gas collecting chamber.

The heating device illustrated in the figures consists, in a manner known per se, of a combustion chamber 1 and of a gas flue 2 configured for guiding hot exhaust gases generated in the combustion chamber 1 with an extra burner not shown, wherein this has an inlet region 2.1 and an outlet region 2.2 and is configured connected to the combustion chamber 1 via the inlet region 2.1, and wherein heat transfer ribs 3 made of a metallic material having a wall thickness are arranged spaced from each other on the gas flue 2 for the heat transfer from the hot exhaust gas to the gas flue 2.

As in the initially mentioned prior art, in the heating device according to the invention, in order to be able to discharge a sufficient amount of exhaust gas from the combustion chamber 1, it is provided that the combustion chamber 1 is configured connected to a plurality (here four) of parallel gas flues 2 through which the exhaust gas flows. The gas flue 2 itself has a (approximately) rectangular cross-sectional area with a length and a width, wherein the length corresponds to a multiple of the width.

Furthermore, it is provided, in a manner known per se, that the gas flue 2 is configured connected to an exhaust gas collecting chamber 4 via the outlet region 2.2. Furthermore, the combustion chamber 1 is thereby arranged above the gas flue 2 and this above the exhaust gas collecting chamber 4. The exhaust gas collecting chamber 4 is in turn connected in a known manner (and therefore not specifically shown) to a chimney of a building or the like.

It is essential for the heating device according to the invention that, on sides of the inlet region 2.1, the wall thickness of the heat transfer ribs 3 and/or the distances of the heat transfer ribs 3 to one another are optionally configured greater than on sides of the outlet region 2.2.

As explained at the outset, these specifications lead to a heating device in which, on the one hand, the heat transfer ribs 3 in the inlet region 2.1 can well withstand the still high temperatures of the exhaust gas and on the other hand, with the aid of thin-walled heat transfer ribs 3 in the outlet area 2.2, ensures particularly good heat transfer.

Figure 2:
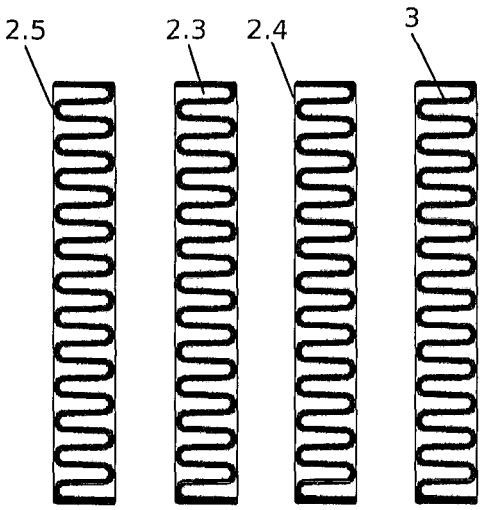
FIG. 2 schematic sectional view of the four gas flues according to FIG. 1 at the level of the inlet region (section A-A)
Figure 3:
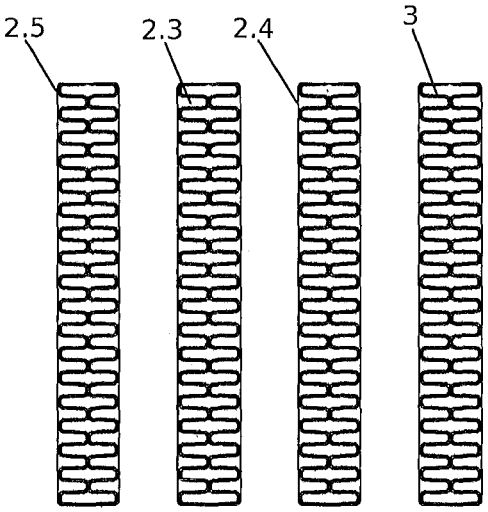
FIG. 3 schematic sectional view of the four gas flues according to FIG. 1 at the level of the outlet region (section B-B)

The figures in this case show a gas flue 2 with two different zones. FIG. 2 shows the heat transfer ribs 3, which are still comparatively thick-walled and arranged with a comparatively large distance from each other, in the inlet region 2.1 (section A-A). FIG. 3, on the other hand, shows the comparatively thin-walled heat transfer ribs 3 arranged at a comparatively small distance in the outlet region 2.2 (section B-B).

As can be readily understood, FIGS. 1 to 3 show a basic constellation. However, gas flues 2 having more than two zones can also be provided for implementing the solution according to the invention. In order, on the one hand, to meet the temperature loads and, on the other hand, the decrease in the volume of the exhaust gas with increasing distance from the combustion chamber 1, it is thus provided, again, in other words, according to the invention, that a) the wall thickness of the heat transfer rib 3 is configured decreasing with increasing distance from the combustion chamber 1 and/or b) that the distance between the heat transfer ribs 3 is configured decreasing with increasing distance from the combustion chamber 1. The said change from zone to zone can be effected continuously or also, which is structurally simpler, stepwise.

As the comparison of FIGS. 2 and 3 shows, it is also particularly preferred to provide that a flow surface 2.3 oriented perpendicular to the main flow direction of the exhaust gas in the gas flue 2 is configured larger in the inlet region 2.1 than in the outlet region 2.2.

With regard to the dimensioning of the components of the heating device according to the invention, in which as already mentioned above, the gas flue 2, on the one hand, is configured for exhaust gas to flow through it and, on the other hand, to be surrounded by water (in particular heater circuit water), a particularly good heat transfer is preferably provided, that a wall of the gas flue 2 arranged between the exhaust gas and the water has a wall thickness which is configured smaller than the smallest wall thickness of the heat transfer rib 3. For this purpose, it is also preferably provided that the wall of the gas flue 2 is formed from a metallic sheet material. This wall of the gas flue extends over the complete length of the heating device.

Considered in more detail, in the heating device according to the invention, in which a wall of the gas flue 2 and the heat transfer ribs 3 are also configured as separate components, it is particularly preferred to provide that the heat transfer ribs 3 are configured as a support for the wall of the gas flue 2 against the external pressure of the water.

In contrast to the above-mentioned prior art, a wall region 2.4 left free from the heat transfer ribs 3, is further provided on the gas flue 2 to further improve the heat transfer in the gas flue 2 for direct contact of the exhaust gas with a wall of the gas flue 2. Thus, in the gas flue 2, on the one hand, there are the wall regions 2.5 which are in contact with the heat transfer ribs 3 and supporting them, and, on the other hand, corresponding wall regions 2.4 that are left free. As shown in the figures, the heat transfer ribs 3 are thereby preferably arranged in one (see in particular FIG. 2) or several rows (see in particular FIG. 3) and multiple S-shapes in the gas flue 2, wherein the stipulation "multiple" simply means that a plurality of S-shapes are arranged in succession in the longitudinal direction.

In addition, since the heating device according to the invention is to be operated as a so-called condensing boiler in order to achieve a high efficiency, it is particularly preferred to provide that the gas flue 2 and/or the heat transfer ribs 3 is/are formed from a material which is resistant to condensate resulting from the exhaust gas.

Figure 4:
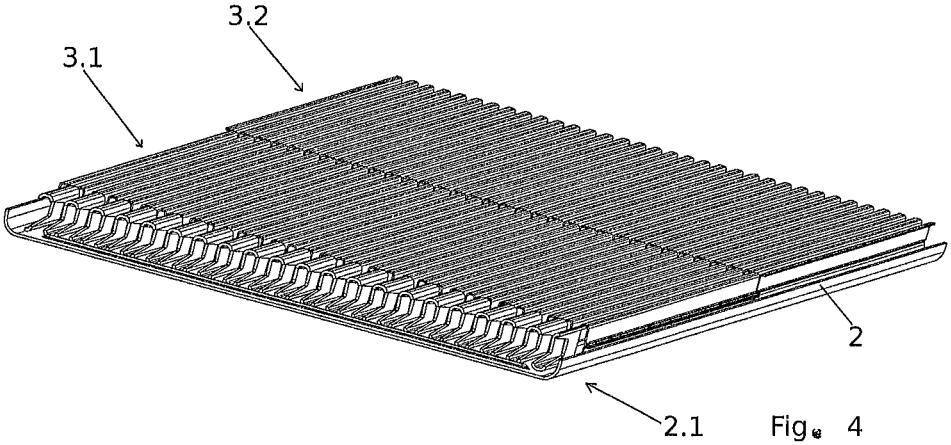
FIG. 4 in perspective, a half-open gas flue having a total of three zones.
Figure 5:
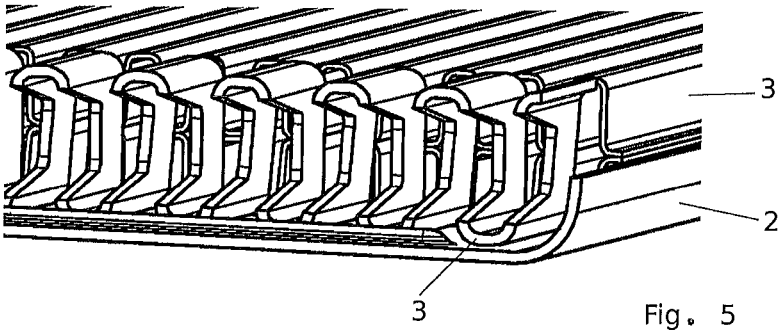
FIG. 5 a sectional enlargement for the embodiment example according to FIG. 4.

FIGS. 4 and 5 show a further exemplary embodiment of the gas flue according to the invention. This gas flue is distinguished by the fact that the heat transfer ribs 3 have a greater distance for the inlet region 2.1 of the gas flue 2 than at an edge region of the gas flue 2 in a central region of the gas flue 2, with reference to a flow of the hot exhaust gas. Again, in other words, a notch is provided in the middle region of the heat transfer ribs 3 at the inlet region.

This specification has the advantage that the hot exhaust gas streaming in, especially in the central region, can initially cool down somewhat before it comes into contact with the heat transfer rib 3. At the same time, however, a sufficient support of the wall of the gas flue 2 is still ensured by the somewhat lengthened formation of the heat transfer ribs 3 in the edge region that is less pressurized with hot exhaust gas.

In FIG. 4, it can also be clearly seen that this gas flue 2 has a total of three different zones. In the front image area, the heat transfer ribs 3 on the inlet side are shown, which, in order to be able to withstand the hot exhaust gas, are appropriately configured thick-walled and arranged at a comparatively large distance from each other. The heat transfer ribs 3 in the middle and the outlet-side region are clearly thin-walled and arranged at a smaller distance from each other.

In addition, it is provided in the embodiment according to FIG. 4 that the heat transfer ribs 3 of a zone (i.e., in a region in which the wall thickness and the distance of the heat transfer ribs 3 do not change) are formed from two sections 3.1, 3.2 arranged one behind the other as seen in the flow direction of the hot exhaust gas, wherein a gap is provided between the sections 3.1, 3.2 and the sections 3.1, 3.2 are preferably arranged offset with respect to one another. This requirement serves to swirl the flow in this zone in order to increase the heat transfer again.

Figure 6:
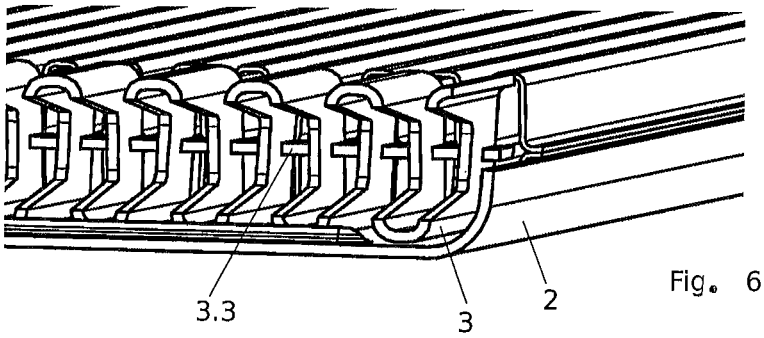
FIG. 6 also enlarged (and also half-opened) a further embodiment having webs between the heat transfer ribs on the inlet region side.

Finally, it is preferably provided with reference to FIG. 6 that webs 3.3 are provided between the heat transfer rib 3 and, in particular, in a central region of the gas flue 2, with reference to a flow of the hot exhaust gas. This requirement also serves to improve the heat transfer.

Although only a few embodiments of the present invention have been shown and described, it is to be understood that many changes and modifications may be made thereunto without departing from the spirit and scope of the invention.

LIST OF REFERENCE NUMBERS

1 Combustion chamber
2 Gas flue
2.1 Inlet region
2.2 Outlet region
2.3 Flow surface
2.4 Wall region
2.5 Wall region
3 Heat transfer rib
3.1 Section
3.2 Section
3.3 Web
4 Exhaust gas collecting chamber

What is claimed is:

1. A heating device, comprising:

a combustion chamber;

a gas flue configured to guide hot exhaust gas generated in the combustion chamber, the gas flue having an inlet region and an outlet region and being connected to the combustion chamber via the inlet region; and heat transfer ribs having a wall thickness and being arranged spaced from each other in the gas flue for the heat transfer from the hot exhaust gas to the gas flue;

wherein the gas flue is configured for exhaust gas to flow therethrough and to be surrounded by water;

wherein on a side of the inlet region, the wall thickness of the heat transfer ribs is configured greater than on a side of the outlet region; and wherein a wall of the gas flue arranged between the exhaust gas and the water has a wall thickness which is configured smaller than a smallest wall thickness of the heat transfer ribs, and wherein webs are provided between the heat transfer ribs in a central region of the gas flue with reference to a flow of the hot exhaust gas.

2. The heating device according to claim 1, wherein a flow surface oriented perpendicular to a main flow direction of the exhaust gas in the gas flue is configured larger in the inlet region than in the outlet region.

3. The heating device according to claim 1, wherein the wall thickness of each of the heat transfer ribs is configured to become smaller with increasing distance from the combustion chamber.

4. The heating device according to claim 1, wherein the distance between the heat transfer ribs is configured to become smaller with increasing distance from the combustion chamber.

5. The heating device according to claim 1, wherein a wall of the gas flue and the heat transfer ribs are configured as separate components, and wherein the heat transfer ribs are configured as support for pressure stabilization of the wall of the gas flue.

6. The heating device according to claim 1, wherein a wall region left free from the heat transfer ribs is provided on the gas flue for contact of the exhaust gas with a wall of the gas flue.

7. The heating device according to claim 1, wherein the gas flue and/or the heat transfer ribs is/are formed from a material resistant to penetration from condensate resulting from the exhaust gas.

8. The heating device according to claim 1, wherein the heat transfer ribs are arranged in single-row or multiple-rows and as plurality of S-shapes in the gas flue.

9. The heating device according to claim 1, wherein the gas flue has a rectangular cross-sectional area with a length and a width, and wherein the length corresponds to a multiple of the width.

* * * * *